US007025421B1

(12) United States Patent
Fowler et al.

(10) Patent No.: US 7,025,421 B1
(45) Date of Patent: Apr. 11, 2006

(54) WORKER'S RECLINER

(76) Inventors: Richard L. Fowler, 2533 Lanyon Dr., Longmont, CO (US) 80503; Sean J. Fowler, 2533 Lanyon Dr., Longmont, CO (US) 80503

( * ) Notice: Subject to any disclaimer, the term of this patent is extended or adjusted under 35 U.S.C. 154(b) by 0 days.

(21) Appl. No.: 10/900,475

(22) Filed: Jul. 28, 2004

Related U.S. Application Data

(60) Provisional application No. 60/490,040, filed on Jul. 28, 2003.

(51) Int. Cl.
*A61G 15/04* (2006.01)
*A47C 1/026* (2006.01)
*A47B 7/00* (2006.01)

(52) U.S. Cl. ..... 297/354.13; 297/84; 297/325; 297/377; 5/610

(58) Field of Classification Search ..... 297/354.13, 297/84, 325, 377, 357; 5/610, 616, 618
See application file for complete search history.

(56) References Cited

U.S. PATENT DOCUMENTS

| | | | | | |
|---|---|---|---|---|---|
| 6,594 | A * | 7/1849 | Linikin | 297/377 X |
| 1,294,378 | A * | 2/1919 | Barnes | 297/357 X |
| 1,366,274 | A * | 1/1921 | Orth | 297/377 X |
| 4,168,099 | A * | 9/1979 | Jacobs et al. | 297/325 |
| 4,660,237 | A * | 4/1987 | Brodnax | 297/377 X |
| 4,691,962 | A * | 9/1987 | Holdt | 297/84 |
| 4,717,169 | A * | 1/1988 | Shaffer | 297/354.13 X |
| 4,795,214 | A * | 1/1989 | Holdt | 297/84 X |
| 5,297,850 | A * | 3/1994 | Guleserian | 297/377 |
| 5,342,114 | A * | 8/1994 | Burke et al. | 297/354.13 X |
| 5,402,544 | A * | 4/1995 | Crawford et al. | 297/354.13 X |
| 5,547,245 | A * | 8/1996 | Knouse | 297/84 X |
| 5,556,166 | A * | 9/1996 | Synnestvedt | 297/377 |
| 5,584,082 | A * | 12/1996 | Crawford et al. | 297/354.13 X |
| 5,681,089 | A * | 10/1997 | Lin | 297/377 X |
| 5,790,997 | A * | 8/1998 | Ruehl | 297/354.13 X |
| 5,865,457 | A * | 2/1999 | Knabusch et al. | 297/354.13 X |
| 5,882,083 | A * | 3/1999 | Robinson | 297/354.13 X |
| 5,931,535 | A * | 8/1999 | Sweet | 297/354.13 |
| 6,059,365 | A * | 5/2000 | Diamond | 297/354.13 |
| 6,212,712 | B1 * | 4/2001 | Topp | 5/610 |
| 6,460,930 | B1 * | 10/2002 | Thornton | 297/354.13 |
| 6,742,206 | B1 * | 6/2004 | Han | 297/354.13 X |
| 6,761,397 | B1 * | 7/2004 | Tseng | 297/354.13 X |
| 6,854,145 | B1 * | 2/2005 | Ruehl et al. | 297/217.6 |
| 6,860,567 | B1 * | 3/2005 | Bauer | 297/354.13 X |
| 6,908,154 | B1 | 6/2005 | Aono | 297/354.13 X |
| 6,912,746 | B1 | 7/2005 | Grove | 297/325 X |

* cited by examiner

*Primary Examiner*—Rodney B. White
(74) *Attorney, Agent, or Firm*—Rick Martin; Patent Law Offices of Rick Martin, P.C.

(57) ABSTRACT

A recliner is suited for airplane mechanics and the like who need seating and backrest support at various heights. A rectangular base has removable caster-type wheels. A rectangular table frame is supported above the base by a pair of scissor-type leg assemblies with adjustable height bracket, slot and pin subassemblies and/or lift assist assemblies. The table frame has a fixed seat cushion. A tiltable backrest can be supported by a slotted cam assembly or other mechanical and/or hydraulic assemblies.

17 Claims, 8 Drawing Sheets

WORKER'S RECLINER

CROSS REFERENCE APPLICATIONS

This application is a non-provisional application claiming the benefits of provisional application No. 60/490,040 filed Jul. 28, 2003.

FIELD OF INVENTION

The present invention relates to a recliner type chair that is suited for airplane mechanics, automotive/marine mechanics, and the like, who work at several different heights such as from a wing to a tire.

BACKGROUND OF THE INVENTION

Ambulance type stretchers have wheels and a variable height bed adjustment. Variable height stools are also known in the art. Airplane mechanics, automated machinery assemblers, etc., sometimes use various stools and flat dollies to support themselves while working on a wide range of equipment such as ranging from wings to engines to tires and landing gear.

What is needed in the art is a stretcher-like conveyance with both an adjustable table height and an adjustable angle back support. The present invention meets these needs with a collapsible and height adjustable table top. The table top has a back support with an angle adjustment. In transport mode the device collapses to a shipping height of about six inches.

SUMMARY OF THE INVENTION

An aspect of the present invention is to provide an airplane mechanic (or the like worker) with an adjustable height body support that has an adjustable tilt backrest.

Another aspect of the present invention is to provide a transport mode with a low profile.

Other aspects of this invention will appear from the following description and appended claims, reference being made to the accompanying drawings forming a part of this specification wherein like reference characters designate corresponding parts in the several views.

The present invention consists of a rectangular base with removable dolly wheels. A scissor-type support assembly supports another rectangular frame at adjustable heights. Once the desired support height is set, the backrest is tilted to a desired angle, preferably with a slotted cam assembly. For shipping, the wheels come off, and the side profile is only several inches high.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
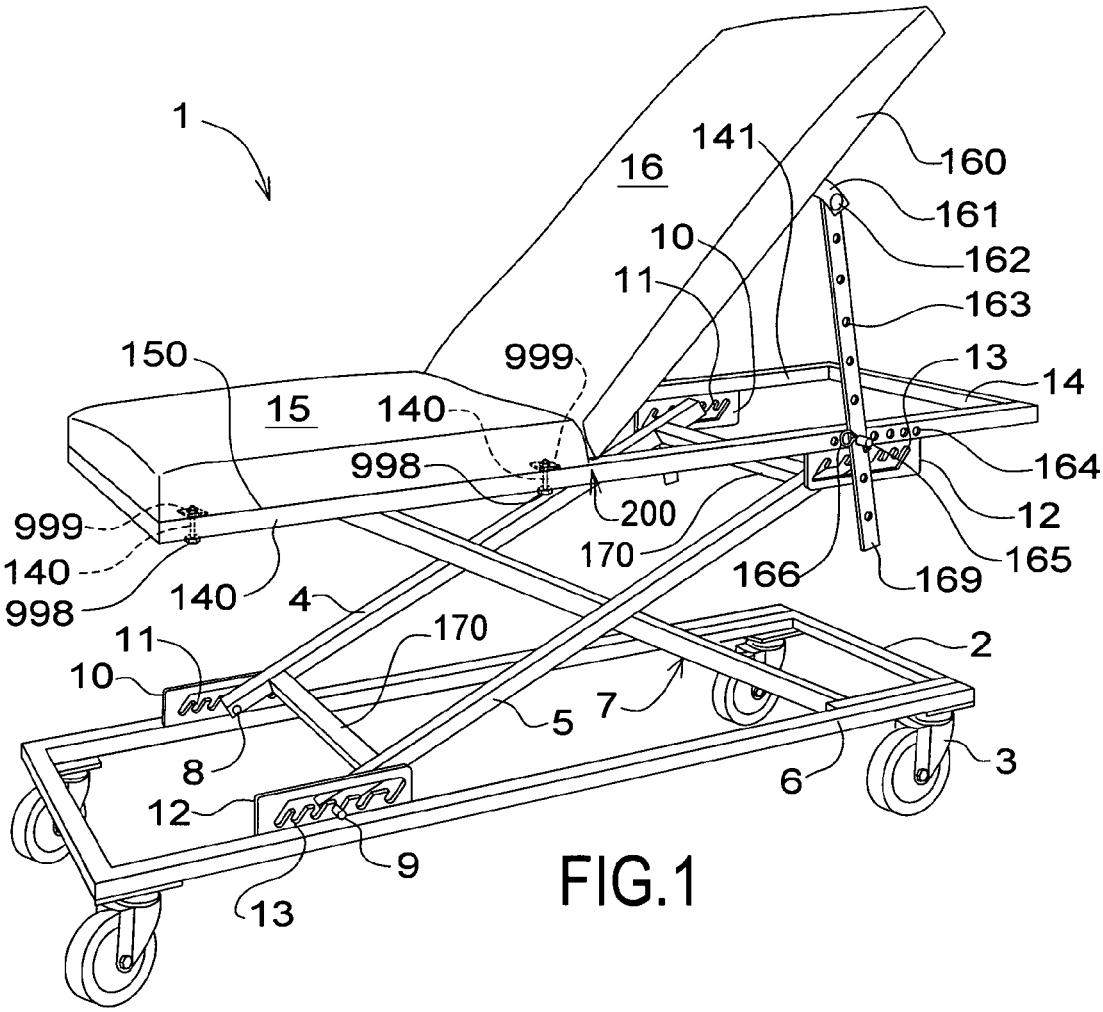
FIG. 1 is a side perspective view of an alternate embodiment recliner.

Referring first to FIG. 1 a recliner 1 has a rectangular frame base 2 with removable caster-type wheels 3 supporting the base 2. A pair of folding scissor-type braces 4,5 attach to the base 2 at pivot points 7,6 at the anchored ends of the scissor braces. The sliding ends of the scissor braces are connected by a crossbar 170. The sliding ends of the scissor braces are connected by a crossbar 170. The sliding ends each have a pin 8,9 facing outbound from the braces 4,5. The pins 8,9 are manually adjustable to fit into selected grooves 11,13 of the support braces 10,12. In operation the rectangular table frame 14 can be adjusted from a lowest height (equivalent to the embodiment shown in FIG. 2, to a raised height shown in FIG. 1. The upper crossbar 170 is equivalent to the lower crossbar 170, with the upper pins 8,9 not visible.

Equivalent table frame 14 adjustable height assemblies include a parallelogram leg structure, a jack-type worm gear assembly used in car jacks, a hydraulic-type car jack assembly, or a pneumatic jack.

The table frame 14 supports a fixed cushion 15 and a reclining backrest cushion 16. Each of the cushions has a solid base 150,160 respectively which could be made of plywood. The base members 150,160 are joined by a piano hinge 200. To adjust the recline angle of the cushion 16, the worker pulls the spring clip 166 from a hole (not shown) in the bolt 165. The worker then aligns a hole from the support rod 169 group of holes numbered 163 with a hole from the group numbered 164 in the sides 140 of the frame 14. A bracket 161 connects the rod 169 to the base 160 via a rivet 162. Side 141 of the frame 14 has an identical adjustment assembly 169, 165, 166, 164 not shown.

Figure 2:
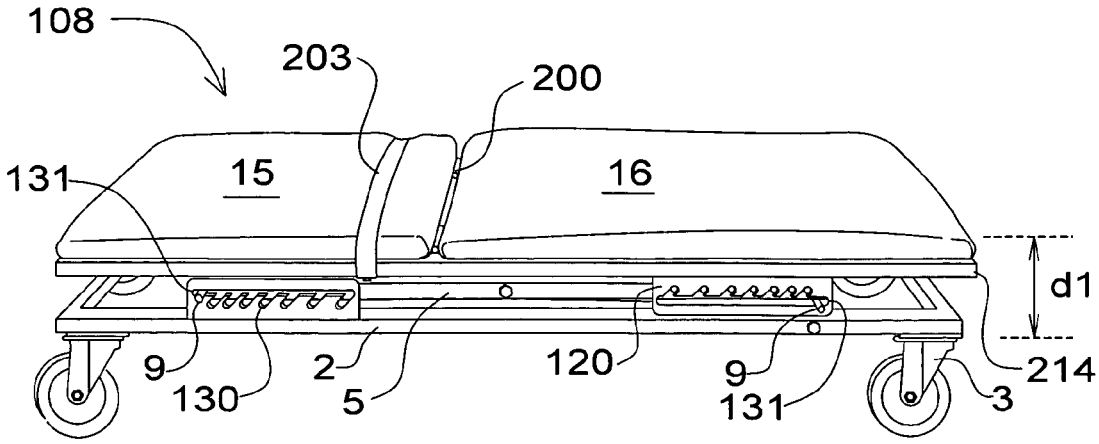
FIG. 2 is a side perspective view of the preferred embodiment in the lowermost and flat mode.

Referring next to FIG. 2 a preferred embodiment recliner 108 has the same base 2 with wheels 3, and scissor-type braces 4,5. The support braces 120 have seven adjustment grooves 130 and a transverse slot 131 for pin 9 to rest in when the upper table frame 214 is in the lowest height mode as shown. For ease of shipping d1=about six inches, wherein the wheels 3 are removed for shipping. A lift strap 203 allows the worker to pull up on it to lift the table frame 214 to a desired height.

Figure 6:
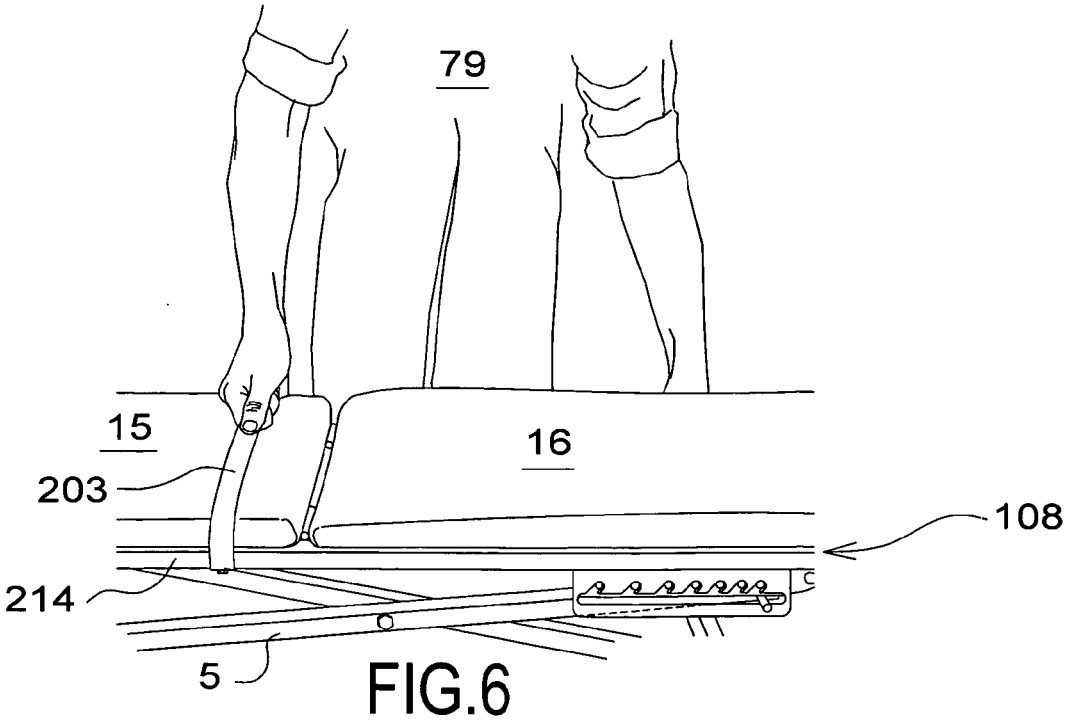
FIG. 6 is a side perspective view of the lift strap in use.
Figure 7:
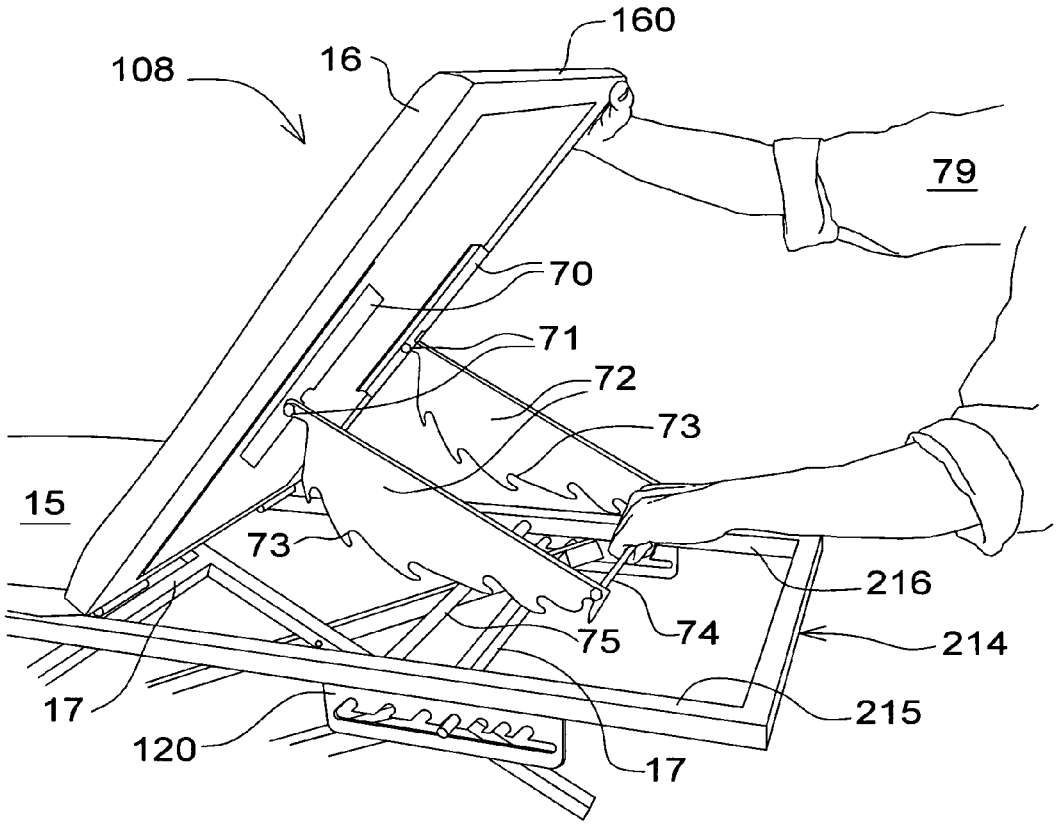
FIG. 7 is a rear perspective view of the slotted cam assembly.

Referring next to FIG. 7 the recliner 108 has a cushion 16 with a base 160. Attached to the base 160 is a pair of anchors 70. Cams 72 pivot from the anchors 70 at points 71. An equivalent design could pre-mold the base 160 to have the pivot points 71 included therein. The cams 72 are supported parallel to each other. At the distal ends of the cams 72 relative to the pivot points 71 is mounted a handle 74 that structurally supports the cams 72 in their parallel arrangement as shown. A plurality of slots 73 provide the adjustable recline angle, wherein the worker 79 grabs the handle 74 and places his chosen pair of slots 73 into the crossbar 75 that extends between the frame sides 215,216. FIG. 6 shows the backrest cushion in the almost totally folded down position. It also shows how the worker 79 can lift the table frame 214 to a desired height via the strap 203 without having to reach all the way across the table frame 214.

Figure 3:
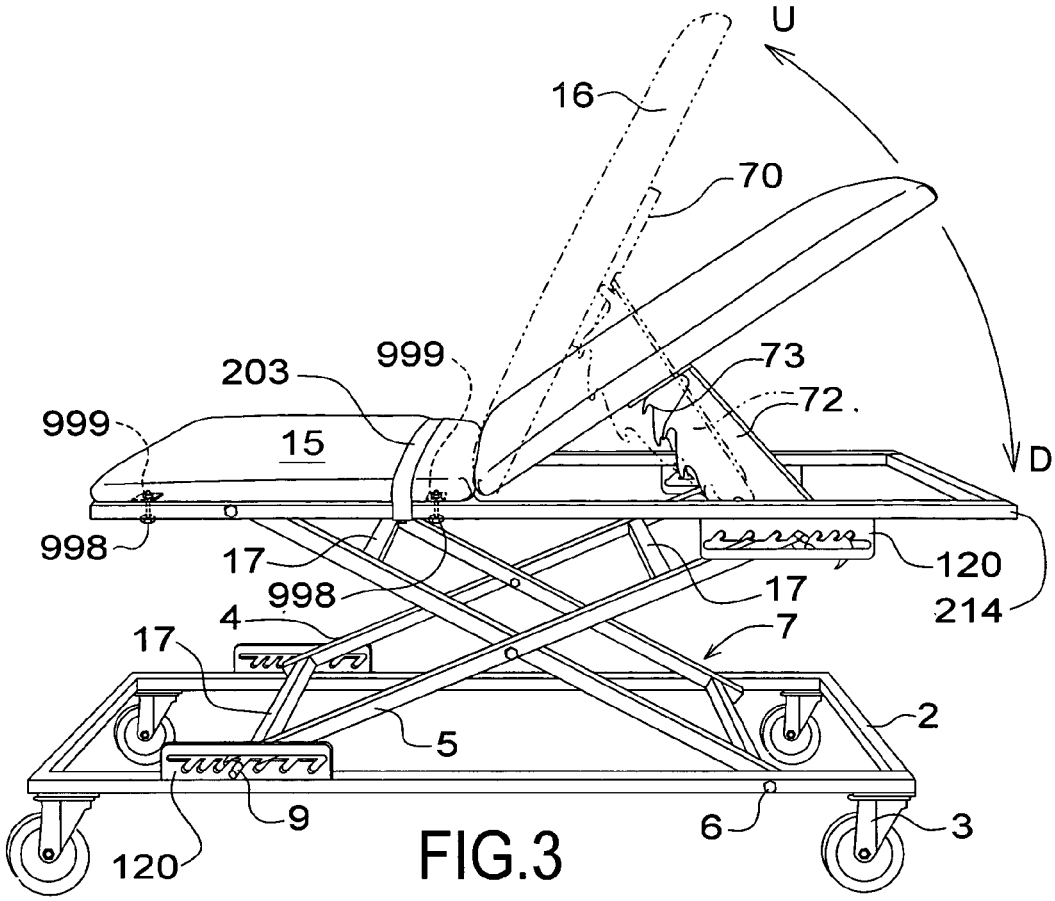
FIG. 3 is a side perspective view of the preferred embodiment at various recline positions.

Referring next to FIG. 3 the table frame is set at a medium height. The arrows up U and down D indicate how the backrest cushion 16 is adjustable to varying recline positions.

Figure 4:
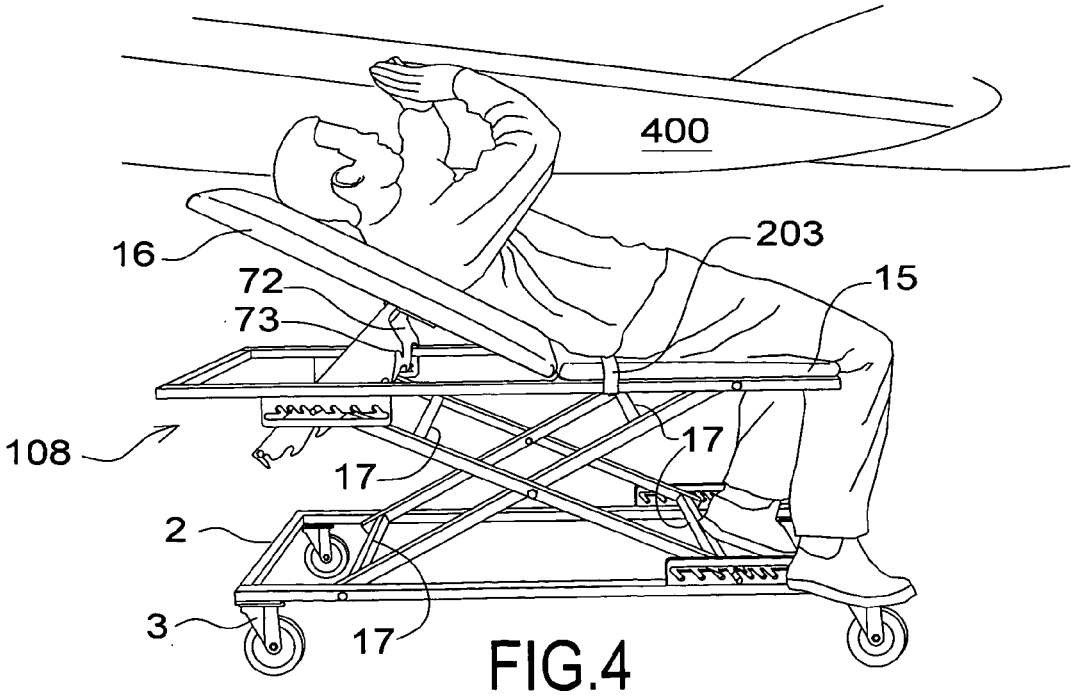
FIG. 4 is a side perspective view of the preferred embodiment in use.

In FIG. 4 the worker 79 is comfortably supported to work on the wing 400.

Figure 5:
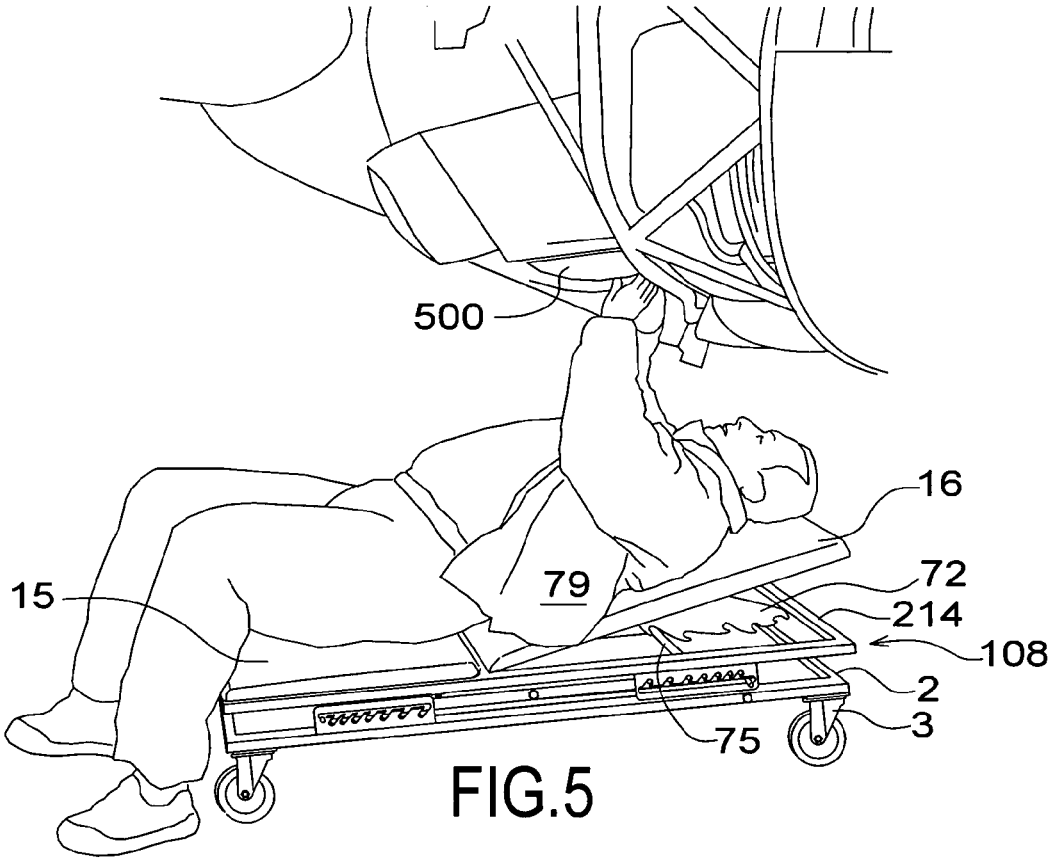
FIG. 5 is a side perspective view of the preferred embodiment in use at a low height.

In FIG. 5 the worker 79 has quickly reconfigured his recliner 108 to be set a lowest height with the backrest cushion 16 set at a moderate incline to work on the lower part of the engine 500. The cushions 15,16 removably fit into the table frame 214 along a peripheral edge of the backs of the cushions. Preferably the cushions 15,16 are the same peripheral dimensions as the frame 14 or 214 so that the cushions rest on the frame. The base members 150,160 have nut plates 999 to receive mounting bolts 998.

Figure 8:
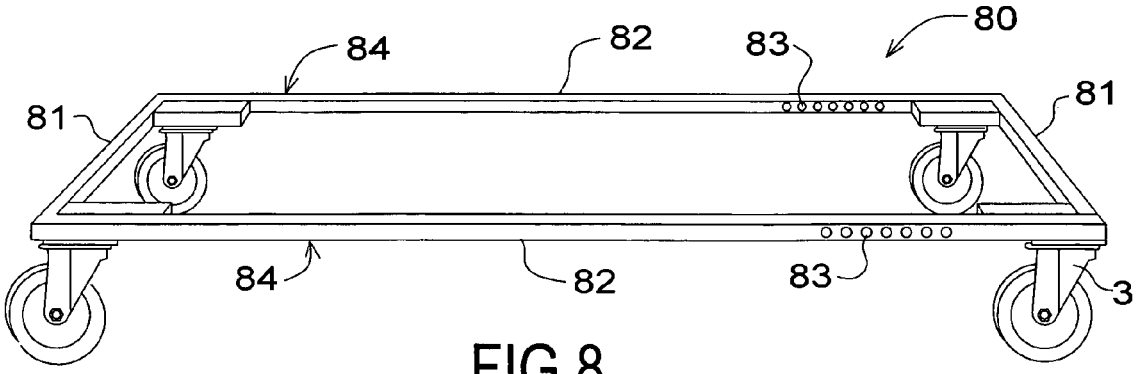
FIG. 8 is a top perspective view of an alternate embodiment base frame.

Referring next to FIG. 8 a base frame 80 consists of transverse segments 81 and longitudinal segments 82. The segments 82 have height adjustment holes 83. Not shown is an alternative pair of scissor arms wherein one set of the scissor arm ends would be anchored at point 84, and the movable set of scissor arm ends would be bolted in holes 83 to provide a chosen height for the rectangular table frame 14 of FIG. 1.

Figure 9:
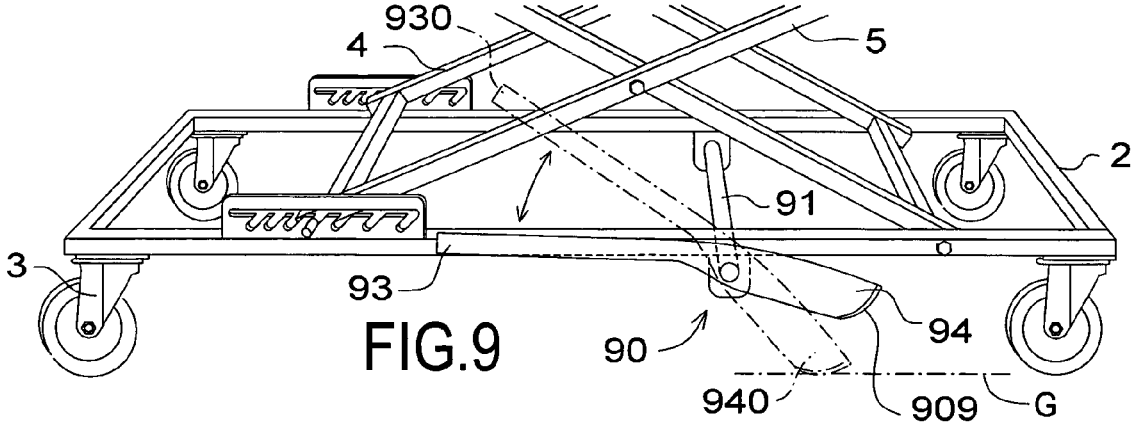
FIG. 9 is a top perspective view of a hand brake attachment.

Referring next to FIG. 9 a hand brake 90 is fitted to a base 2 so that a worker can pull on handle 93 and jam the brake 94 with rubber shield 909 onto the ground G. Dotted lines show handle 930 and brake 940 in the locked position. Crossbar 91 provides a pivot point 92 for the handle and brake assembly 93,94.

Figure 10:
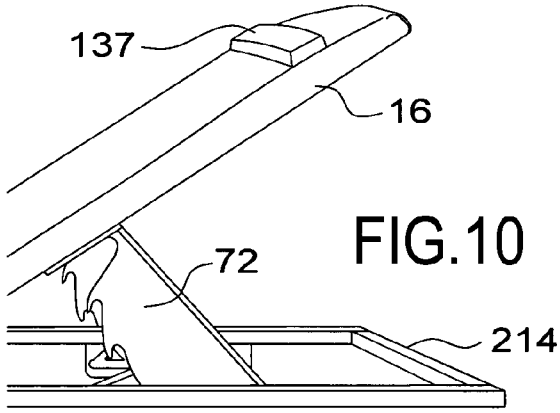
FIG. 10 is a side perspective view of an optional headrest.

Referring next to FIG. 10 the cushion 16 has a headrest 137.

Figure 11:
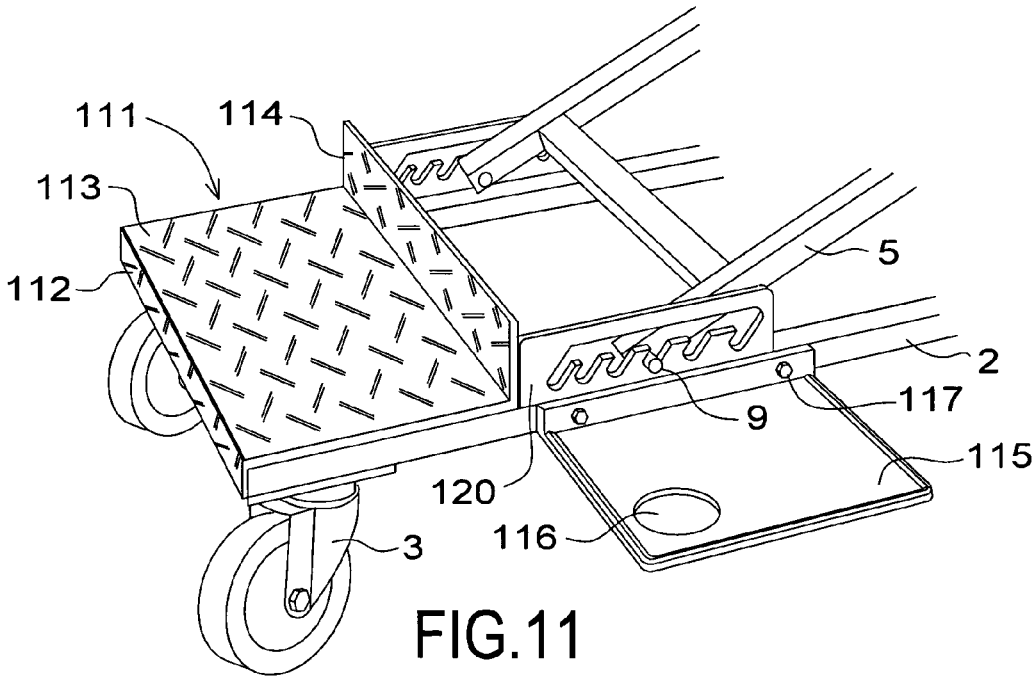
FIG. 11 is a top perspective view of an optional footrest.

Referring next to FIG. 11 a step 111 provides a support for a worker. The step 111 is supported by the base 2. The step 111 may have components 112, 113 and 114 or at least component 113. An accessory table 115 is bolted to the base 2 by bolts 117. A cup holder hole 116 is provided.

Figure 12:
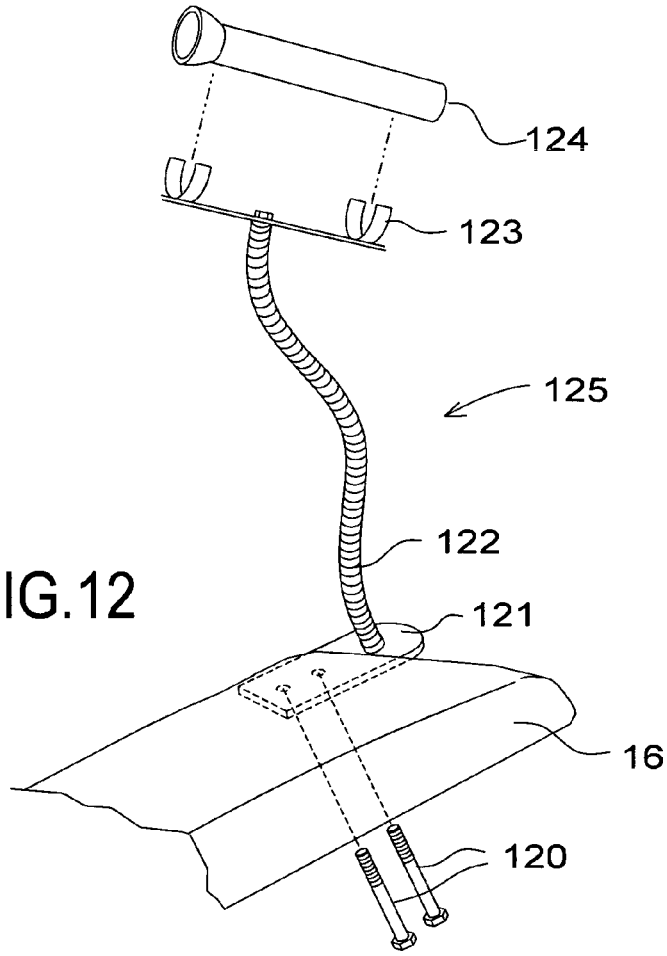
FIG. 12 is an exploded view of an optional flashlight holder.

Referring next to FIG. 12 an accessory lamp as shown consists of a base 121 connected to the cushion 16 by bolts 120. A flexible neck 122 supports clamps 123 which hold a flashlight 124. The lamp 125 could be an A/C powered light not shown, but known in the art.

Figure 13:
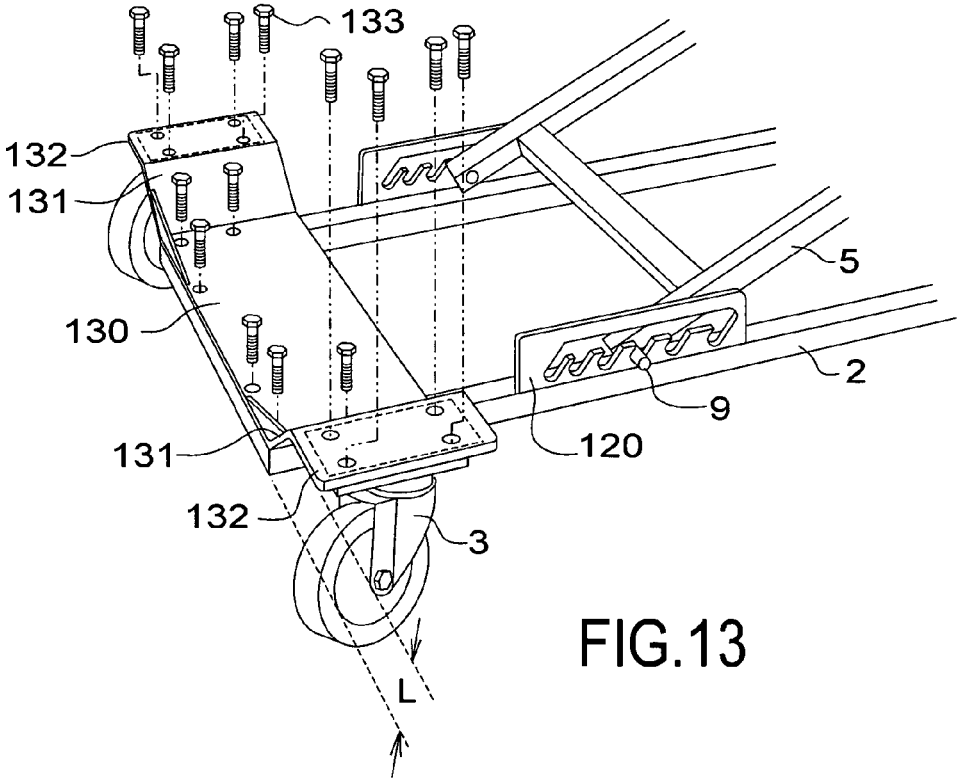
FIG. 13 is an exploded view of an optional frame lowering mount for the wheels.

Referring next to FIG. 13 the frame 2 is lowered a distance L by means of a transverse support 130 that is bolted to frame 2 with bolts 133. The wheels 3 are bolted to platforms 132 with bolts 133. Transition braces 131 connect the platforms 132 to the transverse support 130.

Figure 14:
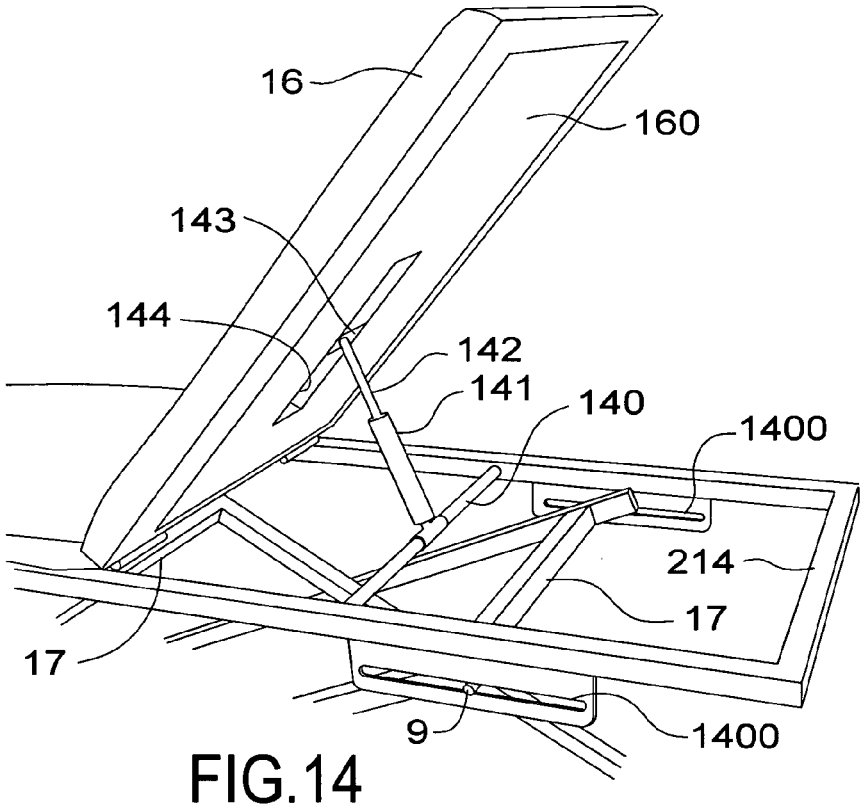
FIG. 14 is a side perspective view of an adjustable piston brace for the backrest.

Referring next to FIG. 14 another version of an adjustable backrest is shown. A crossbar 140 supports a hydraulic base 141 which has an arm 142 that supports the cushion 16 at variable angles. Arm 142 has a flange 143 that slides in a track 144. Any type of base 141 could be used such as pneumatic, hydraulic or mechanical.

Figure 15:
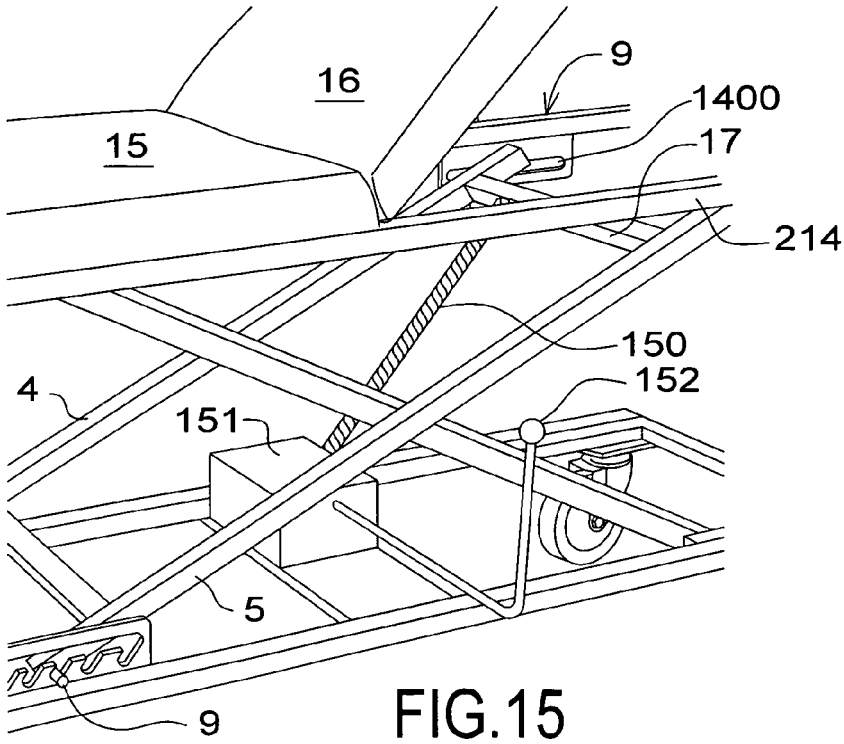
FIG. 15 is a side perspective view of a worm gear brace for the backrest.

Referring next to FIG. 15 another version of an adjustable backrest is shown. The crossbar 17 is driven by a threaded rod 150 which extends in and out of powered gear box 151. The pins 9 of the upper ends of scissor braces 4,5 ride in slots 1400. The worker can control the UP/DOWN control handle 152 while reclined on the cushions 15, 16.

Figure 16:
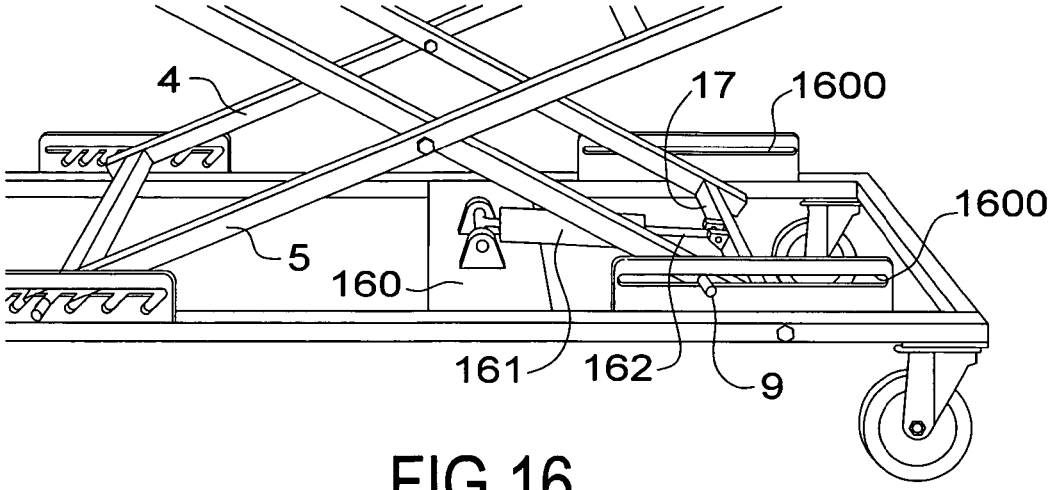
FIG. 16 is a top perspective view of a hydraulic brace for the table.

Referring next to FIG. 16 another version of a powered lift assembly consists of a transverse bracket 160 securing a hydraulic unit 161 which extends an arm 162 to move the crossbar 17 along the slots 1600 via pins 9.

Figure 17:
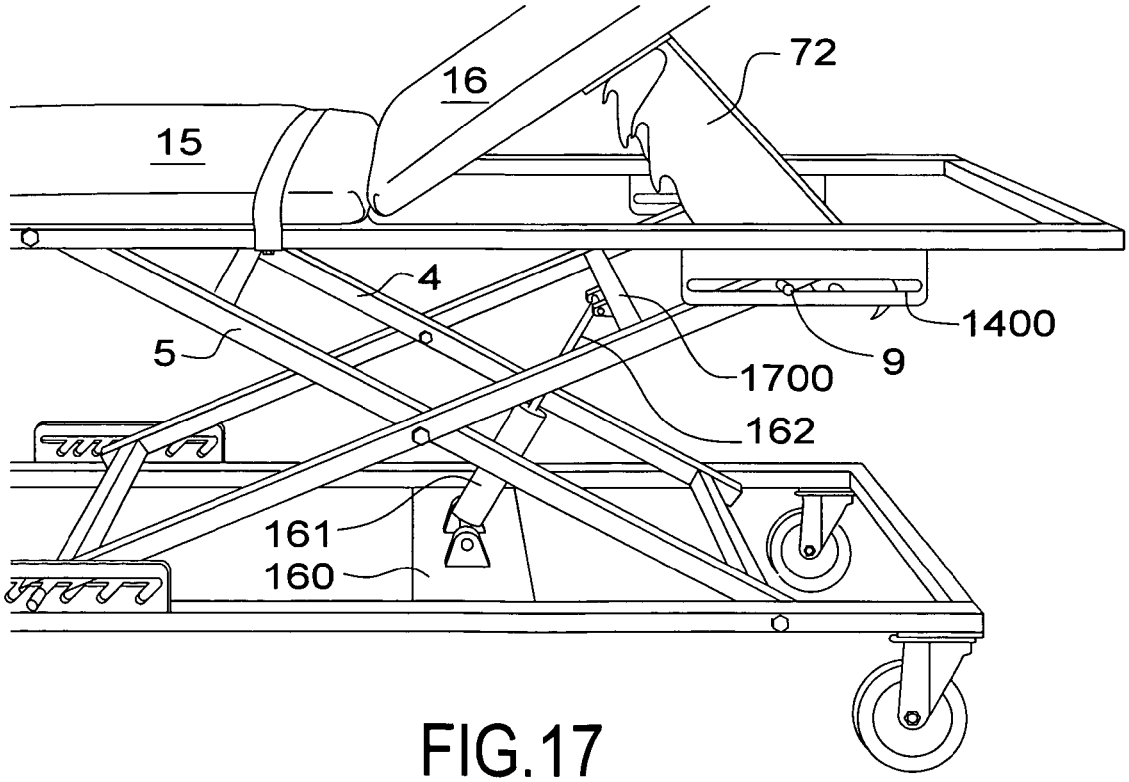
FIG. 17 is a top perspective view of a hydraulic assist for the table.

Referring next to FIG. 17 another version of a powered lift assembly consists of the arm 162 moving the crossbar 1700 which moves the upper ends of scissor braces 4,5 along slots 1400 via pins 9.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

The invention claimed is:

1. A recliner comprising:

a base frame having wheels;

said base frame supporting a table frame on a variable height assembly;

said table frame having a seat and a backrest;

said backrest having a variable recline angle assembly;

wherein the variable recline angle assembly further comprises a pair of slotted cams pivotally attached to a backrest panel, wherein a pair of slots of the slotted cams removably mount to a crossbar on the table frame; and wherein said recliner has a transport mode where the table frame rests parallel to and adjacent the base frame.

2. The recliner of claim 1, wherein the wheels further comprise removable caster-type wheels.

3. The recliner of claim 1, wherein the variable height assembly further comprises a pair of scissor-type legs, each pair having multi-slotted brackets for upper and lower leg support.

4. The recliner of claim 1, wherein the table frame further comprises a lifting strap.

5. The recliner of claim 1, wherein a height of the recliner in the transport mode is about six inches.

6. A recliner comprising:

a rectangular base frame having at least four removable caster-type wheels;

a scissor-type support assembly which supports a table frame at various heights;

said table frame having a seat and a backrest;

said backrest having a tilt assembly comprising a pair of slotted cams where the slots removably mount into a crossbar; and wherein a transport mode is provided with a height of about six inches when the backrest is flat, and the table frame is at a lowest height.

7. The recliner of claim 6, wherein the table frame has a lift strap.

8. The recliner of claim 6, wherein a hinge joins a base of the seat to a base of the backrest, and the seat and backrest assembly mount in the table frame along a peripheral edge.

9. A recliner comprising:

an elongate base having wheels;

a variable height support means functioning to adjust to various heights is mounted to the base;

a table frame means functioning to support a seat and a tiltable backrest is supported by the variable height support means;

said tiltable backrest further comprises at least one support rod pivotally connected to the tiltable backrest at a first end of the support rod;

a second end of the support rod having a removable connection to the table frame means via a pin inserted through a first hole selected from a group of holes in the support rod and a second hole in the table frame means; and wherein a transport mode is formed when the backrest is flat and the table frame means is set at a lowest height.

10. The recliner of claim 9, wherein the table frame means has a lift strap.

11. The recliner of claim 9, wherein the wheels further comprise removable caster type wheels.

12. The recliner of claim 9, wherein the base further comprises a transverse support mounted to the base, said support having a pair of raised platforms to which are mounted the wheels, thereby lowering the base.

13. The recliner of claim 9, wherein the backrest further comprises a lamp.

14. The recliner of claim 9, wherein the base further comprises an accessory table.

15. The recliner of claim 9, wherein the base further comprises a step.

16. The recliner of claim 9, wherein the base further comprises a hand brake.

17. The recliner of claim 9, wherein the table frame means further comprises a group of holes extending longitudinally on the table frame means through which the pin may be inserted.

* * * * *